US008844312B2

(12) United States Patent
Yoshida et al.

(10) Patent No.: US 8,844,312 B2
(45) Date of Patent: Sep. 30, 2014

(54) METHOD OF OPERATING ICE MAKING MACHINE

(75) Inventors: Kazuhiro Yoshida, Toyoake (JP); Yuji Wakatsuki, Toyoake (JP); Hideji Ohta, Toyoake (JP); Hiroki Yamaguchi, Toyoake (JP); Yushi Yonekura, Toyoake (JP)

(73) Assignee: Hoshizaki Denki Kabushiki Kaisha, Aichi (JP)

( * ) Notice: Subject to any disclaimer, the term of this patent is extended or adjusted under 35 U.S.C. 154(b) by 627 days.

(21) Appl. No.: 12/452,019

(22) PCT Filed: Mar. 14, 2008

(86) PCT No.: PCT/JP2008/054815

§ 371 (c)(1),
(2), (4) Date: Dec. 9, 2009

(87) PCT Pub. No.: WO2009/001588

PCT Pub. Date: Dec. 31, 2008

(65) Prior Publication Data

US 2010/0101244 A1 Apr. 29, 2010

(30) Foreign Application Priority Data

Jun. 22, 2007 (JP) ..... 2007-165169

(51) Int. Cl.

| | |
|---|---|
| ***F25C 1/12*** | (2006.01) |
| ***F25C 5/18*** | (2006.01) |
| ***F25C 1/22*** | (2006.01) |

(52) U.S. Cl.

CPC ..... *F25C 5/187* (2013.01); *F25C 2400/14* (2013.01); *F25C 2400/12* (2013.01); *F25C 1/225* (2013.01); *F25C 2700/04* (2013.01); *F25C 1/12* (2013.01); *F25C 2600/02* (2013.01)

USPC ..... 62/348

(58) Field of Classification Search

CPC ..... F25C 1/00; F25C 1/04; F25C 1/12; F25C 1/24

USPC ..... 62/348, 347, 74, 138, 71, 135

See application file for complete search history.

(56) References Cited

U.S. PATENT DOCUMENTS

| | | | | |
|---|---|---|---|---|
| 4,903,505 | A * | 2/1990 | Sakai et al. | 62/347 |
| 5,119,639 | A * | 6/1992 | Bein et al. | 62/137 |
| 5,239,836 | A * | 8/1993 | Sakai | 62/233 |

(Continued)

FOREIGN PATENT DOCUMENTS

| | | |
|---|---|---|
| JP | S54-7450 | 1/1979 |
| JP | S59-26575 | 2/1984 |

(Continued)

OTHER PUBLICATIONS

JP 2005-188868 Machine Translation.*

*Primary Examiner* — Frantz Jules
*Assistant Examiner* — Emmanuel Duke
(74) *Attorney, Agent, or Firm* — DLA Piper LLP (US)

(57) ABSTRACT

A method of operating an ice making machine efficiently provides clean ice blocks. A special water-discharge operation which is performed when an ice storage switch (TS) provided at an ice storage chamber (16) storing ice blocks (M) separated in a deicing operation detects that the ice storage chamber (16) is full of ice discharges the ice-making water from the ice-making water tank (20) via water discharge means (44) by releasing a water discharge valve (DV) provided at the water discharge means (44). Then, the special water-discharge operation is terminated by closing the water discharge valve (DV) when a preset duration time (T) passes after a float switch (FS) provided at the ice-making water tank (20) detects an ice-making completion water level (LWL) of the ice-making water in the ice-making water tank (20) after discharge of the ice-making water to outside is started.

1 Claim, 6 Drawing Sheets

(56) References Cited

U.S. PATENT DOCUMENTS

| | | | | | |
|---|---|---|---|---|---|
| 5,291,747 | A * | 3/1994 | Sakai et al. | ..... | 62/135 |
| 5,345,782 | A * | 9/1994 | Takahashi et al. | ..... | 62/344 |
| 6,414,301 | B1 * | 7/2002 | Borg et al. | ..... | 250/222.1 |
| 2004/0261434 | A1 * | 12/2004 | Zentner et al. | ..... | 62/137 |
| 2005/0155360 | A1 * | 7/2005 | Yoshida et al. | ..... | 62/135 |

FOREIGN PATENT DOCUMENTS

| | | | | | |
|---|---|---|---|---|---|
| JP | H4-143566 | | 5/1992 | | |
| JP | H4-268180 | | 9/1992 | | |
| JP | 05045033 | * | 2/1993 | ..... | F25C 1/12 |
| JP | H5-45033 | | 2/1993 | | |
| JP | 2005-188868 | * | 7/2005 | ..... | F25C 1/12 |

* cited by examiner

METHOD OF OPERATING ICE MAKING MACHINE

TECHNICAL FIELD

The present invention relates to a method of operating an ice making machine, which performs a water-discharge operation of discharging ice-making water from an ice-making water tank via water discharge means communicating with the outside.

BACKGROUND ART

A down flow type ice making machine is widely used as an ice making machine to produce a large quantity of ice blocks for its simple configuration and low ice-making cost. The down flow type ice making machine is configured in such a way that an evaporation pipe led out from a freezing apparatus is disposed at an ice making part provided upright vertically, and ice-making water is sprayed onto the ice making part cooled by a refrigerant which flows in the evaporation pipe in an ice-making operation, thereby producing ice blocks. The ice making machine is configured to have an ice-making water tank to store ice-making water, so that at the time of the ice-making operation, the ice-making water in the ice-making water tank is pumped out to the ice making part by an ice-making water pump, and ice-making water which has not been iced is collected into the ice-making water tank, and is then fed out toward the ice making part again. When the ice-making operation is shifted to a deicing operation after completion of ice making at the ice making part, the ice making machine causes a hot gas to flow through the evaporation pipe and sprays deicing water onto the back side of the ice making part to accelerate melting of icing surfaces of ice blocks with respect to the ice making part, and ice blocks separated from the ice making part are stored in an ice storage chamber. The deicing water is collected into the ice-making water tank, and is used as ice-making water in the next ice-making operation.

In the ice making machine, in the ice-making operation, a portion of the ice-making water excluding an impurity, such as calcium, contained therein is iced at the ice making part, and the impurity is collected together with uniced water into the ice-making water tank. That is, the impurity in the ice-making water stored in the ice-making water tank is gradually condensed by the repetitive ice-making operation. This brings about problems, such as impurity-originated clogging of the ice-making water pump, piping or the like to supply ice-making water to the ice making part, and reduction of the ice-making efficiency originated from adhesion of the impurity to the ice making part.

In this respect, there has been proposed an ice making machine which performs a water-discharge operation of discharging ice-making water remaining in an ice-making water tank at the ice-making completion water level outside after an ice-making operation is completed (see Patent Document 1). The ice making machine disclosed in Patent Document 1 has water discharge means that includes an overflow pipe which defines the maximum water level of ice-making water remaining in the ice-making water tank, a water discharge pipe connecting an ice-making water pump to pump out the ice-making water from the ice-making water tank to an ice making part to the overflow pipe, and a valve to open/close the passage of the water discharge pipe. In the water-discharge operation, the ice making machine of Patent Document 1 rotates the ice-making water pump in the reverse direction to the rotation in the ice-making operation, and releases the valve to discharge the ice-making water outside via the water discharge pipe and the overflow pipe. In the ice making machine, counting a predetermined discharge time is started at the same time as the driving of the pump and the releasing of the valve, and when the discharge time passes, the pump is stopped and the valve is closed, terminating the water-discharge operation. After the water-discharge operation is completed, the ice making machine starts a deicing operation.

PATENT DOCUMENT 1: Japanese Patent Application Laid-Open No. Hei 5-45033

DISCLOSURE OF INVENTION

Problems to be Solved by the Invention

In general, an ice making machine has an ice storage switch, provided at an ice storage chamber for storing ice blocks, to detect the ice storage state, and stands by and does not go to the ice-making operation when the deicing operation is completed. That is, it is pointed out that the ice making machine stands by with ice-making water remaining in the ice-making water tank, bringing about problems of deposition of an impurity in the ice-making water tank and breeding of bacteria. Then, an operation of starting the ice-making operation after performing the water-discharge operation to discharge the ice-making water is performed before the ice-making operation is started upon consumption of ice blocks in the ice storage chamber. When such an operation is performed, the ice-making operation cannot be started immediately after the standby state, resulting in reduction in ice-making performance.

Accordingly, there is an idea of performing the water-discharge operation by driving the ice-making water pump and releasing the water discharge valve, for example, when the ice storage switch detects a full-of-ice state. When the deicing operation is completed, however, a large amount of ice-making water is stored in the ice-making water tank at the ice-making start water level, and it takes a longer time to discharge water as compared with the case of discharging a small amount of ice-making water at the ice-making completion water level after completion of the ice-making operation as mentioned above. Even when the water-discharge operation is performed, a scale may be deposited onto the ice-making water pump, the water discharge pipe and the overflow pipe with the passage of time, reducing the amount of water discharged by the water discharge means per unit time. In this case, the preset discharge time differs from the actual time needed for water discharge, so that the discharge time should be set in consideration of some extra time to surely discharge ice-making water from the ice-making water tank. This makes the discharge time longer, so that even when ice blocks are consumed, the water-discharge operation is not completed and the operation cannot be shifted to the ice-making operation. This brings about a problem of degrading the ice-making performance of the ice making machine per unit time.

Accordingly, the present invention has been contrived in consideration of the inherent problems of the operation methods of the ice making machines according to the related art and to overcome the problems, and it is an object of the invention to provide a method of operating an ice making machine which can efficiently produce clean ice blocks.

Means for Solving the Problems

To overcome the problems and achieve the desirable object, the subject matter of the present invention provides a method of operating an ice making machine which performs an ice-making operation of supplying ice-making water from an ice-making water tank to a cooled ice making part to produce ice blocks in the ice making part, collecting uniced water flowing down from the ice making part into the ice-making water tank to be circulated as ice-making water, a deicing operation of heating the ice making part to separate the ice blocks from the ice making part, and a water-discharge operation of discharging the ice-making water from the ice-making water tank via water discharge means communicating with outside, characterized in that the water-discharge operation which is performed when ice storage detection means provided at the ice storage chamber storing the ice blocks separated in the deicing operation detects that the ice storage chamber is full of ice discharges the ice-making water from the ice-making water tank via the water discharge means by releasing a water discharge valve provided at the water discharge means after the deicing operation is completed, and is terminated by closing the water discharge valve when a preset duration time passes after water level detection means provided at the ice-making water tank detects a prescribed water level of the ice-making water in the ice-making water tank after discharge of the ice-making water to outside is started.

According to the subject matter of the present invention, when the ice storage chamber becomes full of ice, the water-discharge operation is performed after completion of the deicing operation, and there is not a standby state with ice-making water stored in the ice-making water tank, thus making it possible to avoid the problems of breeding of bacteria in the ice-making water tank, deposition of an impurity in the ice-making water tank, etc. Although a large amount of ice-making water is stored in the ice-making water tank when the deicing operation is completed, measuring the duration time starts when the amount of the ice-making water whose prescribed water level is to be detected by the water level detection means becomes small, ensuring a high predictability of the time needed to discharge the remaining ice-making water and making it possible to minimize the time needed for the water-discharge operation.

Effect of the Invention

According to the method of operating an ice making machine of the invention, clean ice blocks can be efficiently produced by performing the water-discharge operation.

BEST MODE FOR CARRYING OUT THE INVENTION

Next, a method of operating an ice making machine according to the present invention will be described below with reference to the accompanying drawings by way of an ice making machine which can favorably execute this method.

Embodiment

Figure 1:
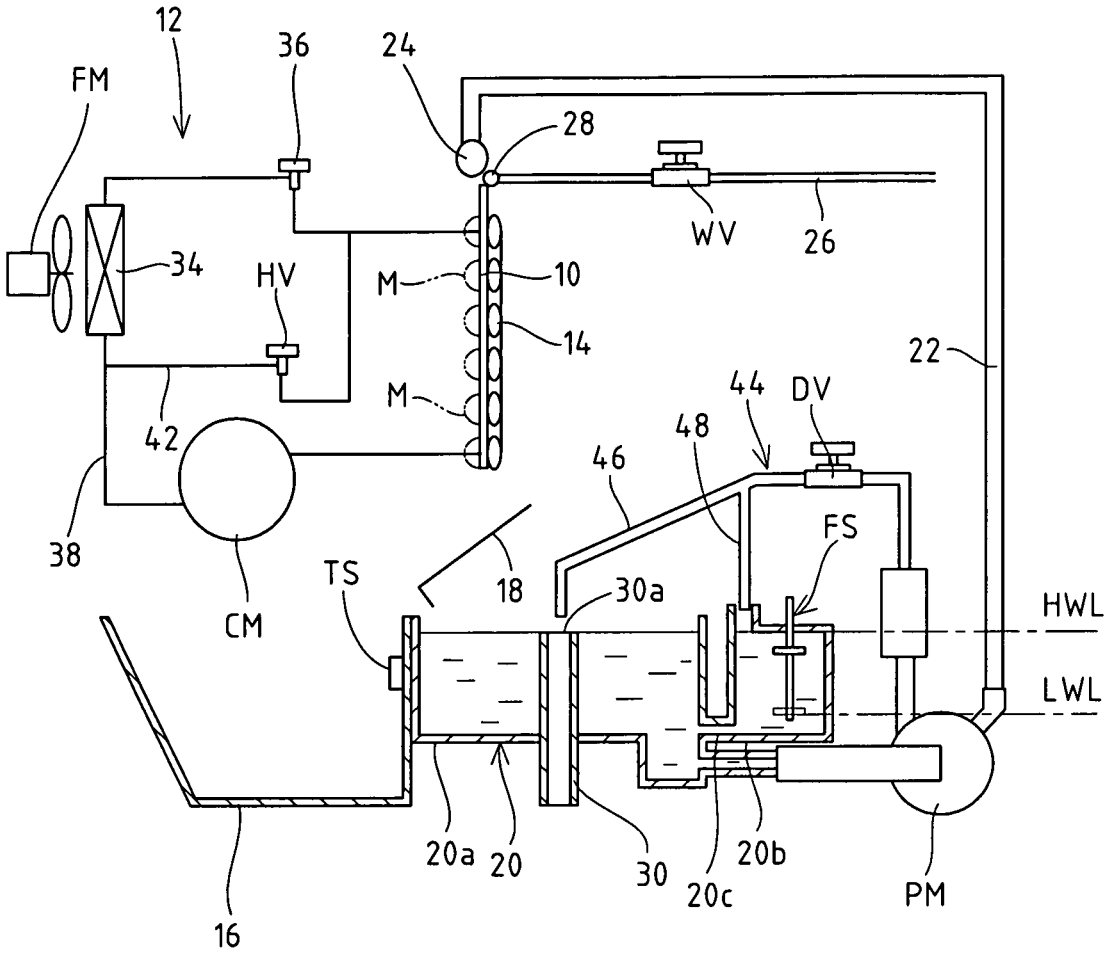
FIG. 1 is a schematic diagram showing an ice making machine according to a preferred embodiment of the present invention.

A down flow type ice making machine as shown in FIG. 1 is configured to basically repeat an ice-making operation of producing ice blocks M and a deicing operation of separating the produced ice blocks M (see FIG. 5), and perform a water-discharge operation of discharging ice-making water outside from an ice-making water tank 20 by using water discharge means 44 at an adequate timing. According to the embodiment, the water-discharge operation is performed in every predetermined cycle between the ice-making operation and the deicing operation and after completion of the deicing operation when a full-of-ice state in an ice storage chamber 16 is detected. Note that the water-discharge operation which is performed between the ice-making operation and the deicing operation is called "normal water-discharge operation" and the water-discharge operation which is performed in case of detecting a full-of-ice state in the ice storage chamber 16 is called "special water-discharge operation" to particularly distinguish the operations. The ice making machine is set so as to start the deicing operation when activated.

Figure 2:
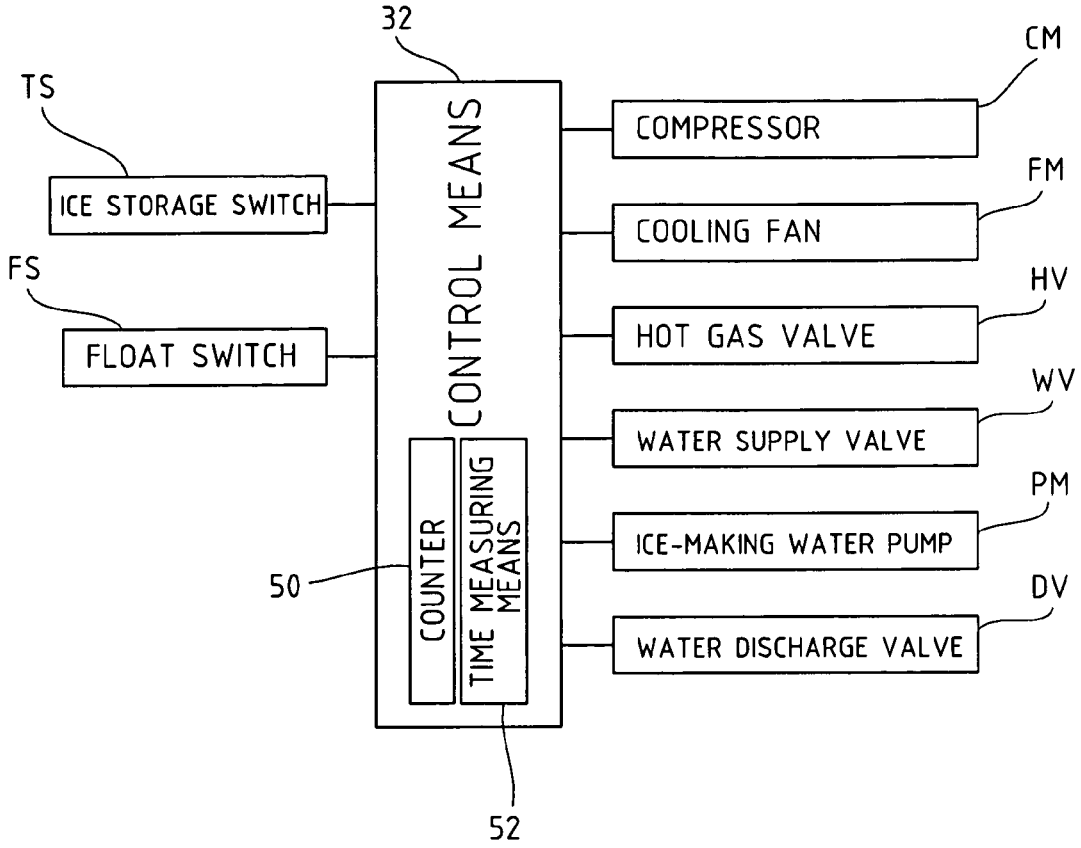
FIG. 2 is a control block diagram of the ice making machine according to the embodiment.

The ice making machine has an ice making plate (ice making part) 10 arranged in a vertical posture, and is configured to cause a freezing apparatus 12 to circulate a refrigerant in an evaporation pipe (evaporator) 14, securely fixed to the back of the ice making plate 10, in the ice-making operation mode to forcibly cool the ice making plate 10. A guide plate 18 which guides ice blocks M, separated from the ice making plate 10 in the deicing operation, to the ice storage chamber 16 located obliquely below is disposed in an inclined posture directly under the ice making plate 10. An ice storage switch (ice storage detection means) TS which detects if there is an ice block M is disposed at the upper portion of the ice storage chamber 16, and a signal from the ice storage switch TS is input to control means 32 (see FIG. 2). In a full-of-ice state where the ice storage switch TS detects ice blocks M (ON), the ice making machine performs a special water-discharge operation after completing the deicing operation, and stands by for the initiation of the next ice-making operation until the ice storage switch TS does not detect ice blocks M (OFF) (see FIG. 5). Multiple apertures (not shown) are formed in the guide plate 18, so that ice-making water supplied to the ice-making surface of the ice making plate 10 in the ice-making operation and deicing water supplied to the back of the ice making plate 10 in the deicing operation are collected into the underlying ice-making water tank 20 via the apertures of the guide plate 18.

The ice-making water tank 20 includes a main tank 20*a* provided under the ice making plate 10 to collect ice-making water (uniced water) or deicing water flowing down from the ice making plate 10, and a sub tank 20*b* which is communicated with the main tank 20*a* via a connection pipe 20*c* and whose water level changes according to a change in water level in the main tank 20*a*. An overflow pipe 30 which discharges ice-making water outside is provided inside the main tank 20*a* with an opening 30*a* open upward, and an ice-making start water level HWL, the upper limit of the ice-making water stored in the ice-making water tank 20, is defined by the position of the opening 30*a*. A float switch FS having a floater which floats up and down according to a change in the water level of the ice-making water is provided in the sub tank 20*b*, and detects an ice-making completion water level (prescribed water level) LWL or the lower limit of the ice-making water. The float switch FS is set so as to become an ON state when the water level in the sub tank 20*b* is higher than the preset ice-making completion water level LWL, and become an OFF state when the water level falls to the ice-making completion water level LWL. This ON/OFF signal is input to the control means 32 (see FIG. 2). According to the embodiment, the ice-making operation is started from the ice-making start water level HWL defined by the overflow pipe 30, and is completed when the water level in the ice-making water tank 20 drops due to production of ice blocks M on the ice making plate 10 and the float switch FS detects the ice-making completion water level LWL.

The ice making machine includes an ice-making water supply system which supplies ice-making water to the ice making plate 10 from the ice-making water tank 20 in the ice-making operation mode, and a deicing water supply system which supplies sprays water of normal temperature (hereinafter called "deicing water") on the back of the ice making plate 10 to increase the temperature of the ice making plate 10 and accelerate separation of ice therefrom in the deicing operation mode. The ice-making water supply system includes an ice-making water pump PM, an ice-making water supply pipe 22, an ice-making water sprayer 24, and the ice-making water tank 20 (see FIG. 1). The ice-making water supply pipe 22 led out from the ice-making water tank 20 via the ice-making water pump PM is connected to the ice-making water sprayer 24 provided above the ice making plate 10. The ice-making water sprayer 24 is configured to have multiple spray holes (not shown) formed therein, so that ice-making water pumped out from the ice-making water tank 20 is sprayed onto the ice-making surface of the ice making plate 10 through the spray holes. As the ice-making water flowing down on the ice-making surface, a plurality of ice blocks M with a predetermined shape are produced on the ice-making surface. Note that uniced water which flows down, uniced, on the ice making plate 10 is collected into the ice-making water tank 20 through the apertures of the guide plate 18.

The deicing water supply system includes a deicing water supply pipe 26 connected to an external tap water supply system, a deicing water sprayer 28 provided at the upper portion of the back of the ice making plate 10 and connected with the deicing water supply pipe 26, and a water supply valve WV, such as an electromagnetic valve or motor operated valve, intervened in the deicing water supply pipe 26 (see FIG. 1). The water supply valve WV is released in the deicing operation mode, so that the ice making plate 10 is heated by deicing water which is sprayed onto the back of the ice making plate 10 through multiple spray holes (not shown) formed in the deicing water sprayer 28 and flows down. Like the ice-making water, the deicing water flowing down on the back of the ice making plate 10 is collected into the ice-making water tank 20 through the apertures of the guide plate 18, and will be used as ice-making water at the time of the next ice-making operation.

The water discharge means 44 includes the ice-making water pump PM which also serves as the pump in the ice-making water supply system, the overflow pipe 30, a water discharge pipe 46 which has one end connected to the ice-making water pump PM and the other end (discharge end) positioned above the opening 30*a* of the overflow pipe 30, and a water discharge valve DV, such as an electromagnetic valve or motor operated valve, intervened in the water discharge pipe 46 to open or close the passage of the water discharge pipe 46. The ice-making water pump PM according to the embodiment is configured to be able to select a discharge passage according to the rotational direction, so that ice-making water is pumped out to the ice-making water supply pipe 22 in the ice-making water supply system at the time of normal rotation while ice-making water is pumped out to the water discharge pipe 46 of the water discharge means 44 at the time of reverse rotation. The water discharge pipe 46 is provided with a sub water discharge pipe 48 which is branched at the downstream of the water, discharge valve DV in the discharge direction thereof, the discharge end of the sub water discharge pipe 48 being positioned above the sub tank 20*b*. The water discharge pipe 46 is set in such a way that the discharge amount of the ice-making water therein per unit time becomes larger than that in the sub water discharge pipe 48. In the water-discharge operation, the ice-making water pump PM is rotated in the reverse direction and the water discharge valve DV is released to discharge the ice-making water in the ice-making water tank 20 to the overflow pipe 30 via the water discharge pipe 46, and is discharged outside via the overflow pipe 30.

As shown in FIG. 1, the freezing apparatus 12 has a compressor CM, a condenser 34, an expansion valve 36 and the evaporation pipe 14 connected in such a way that a refrigerant pipe 38 allows the refrigerant to circulate in the named order. In the ice-making operation, with the cooling fan FM driven to cool the condenser 34, the ice making machine drives the compressor CM to supply the refrigerant to the evaporation pipe 14 via the condenser 34 and the expansion valve 36, thereby forcibly cooling the ice making plate 10 through the heat exchange with the refrigerant. Then, the vapor refrigerant evaporated by the evaporation pipe 14 repeats the cycle of being fed back to the compressor CM via the refrigerant pipe 38 and supplied to the condenser 34 again.

The freezing apparatus 12 has a hot gas pipe 42 branched from the discharge side of the compressor CM and connected to the inlet side of the evaporation pipe 14, and has a hot gas valve HV intervened in the hot gas pipe 42 to open or close the passage thereof under the control of the control means 32. The ice making machine is configured in such a way that in the deicing operation, the hot gas is supplied to the evaporation, pipe 14 from the compressor CM via the released hot gas valve HV and hot gas pipe 42, thus heating the ice making plate 10 with the hot gas.

In the ice making machine, means of detecting various states of the float switch FS, the ice storage switch TS, etc. is connected to the control means 32 which is comprised of a microcomputer or the like which performs the general electric control. In the ice making machine, various components, such as the compressor CM, the cooling fan FM, the hot gas valve HV, the water supply valve WV and the ice-making water pump PM, are controlled based on the settings of the detection means and the control means 32 to automatically perform the ice-making operation, the deicing operation and the water-discharge operation. In the ice making machine according to the embodiment, a counter 50 which determines the cycle of the water-discharge operation which is performed between the ice-making operation and the deicing operation, and time measuring means 52 which measures a duration time T in the water-discharge operation are installed in the control means 32.

Figure 3:
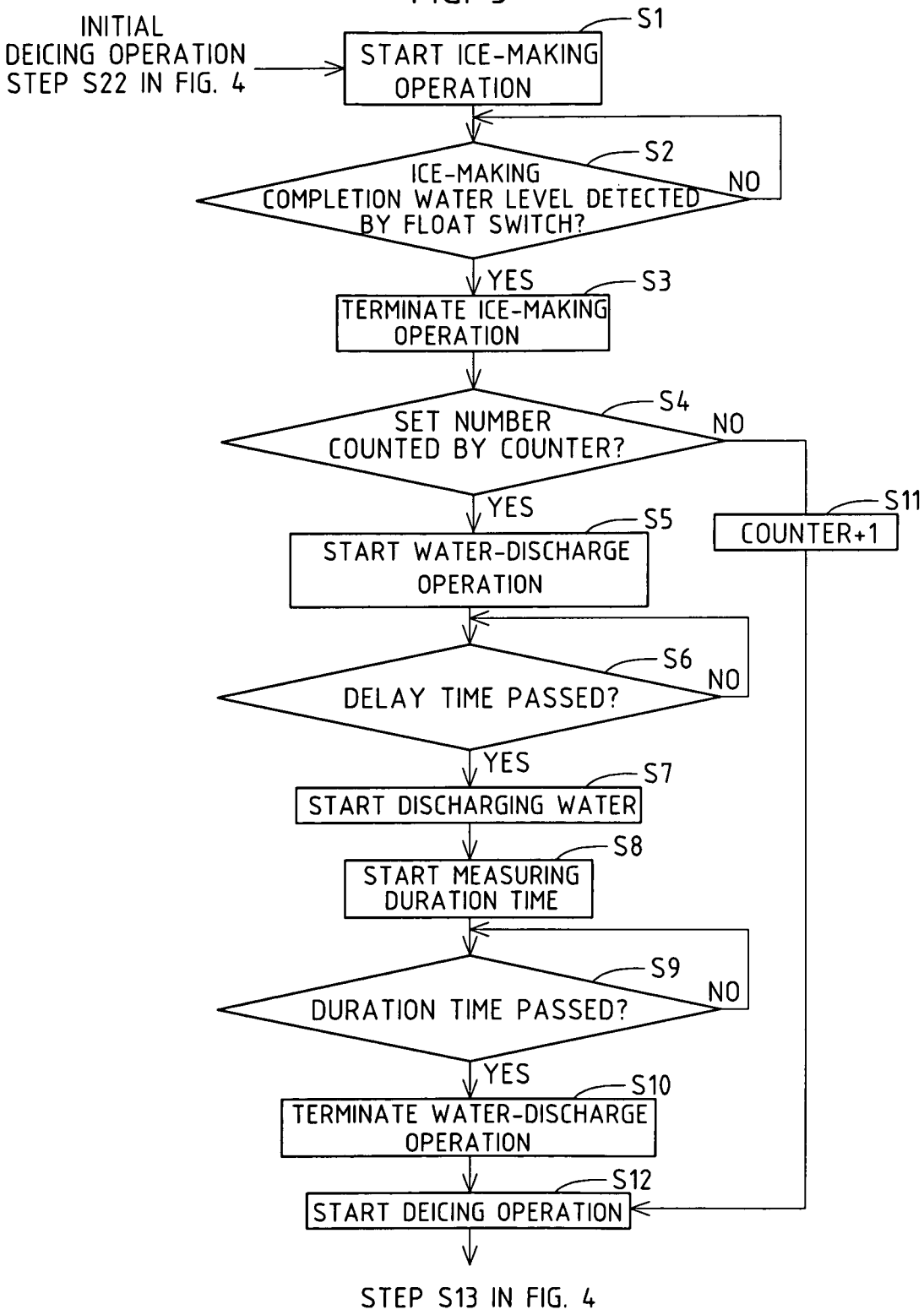
FIG. 3 is a flowchart illustrating a normal water-discharge operation of the ice making machine according to the embodiment.
Figure 4:
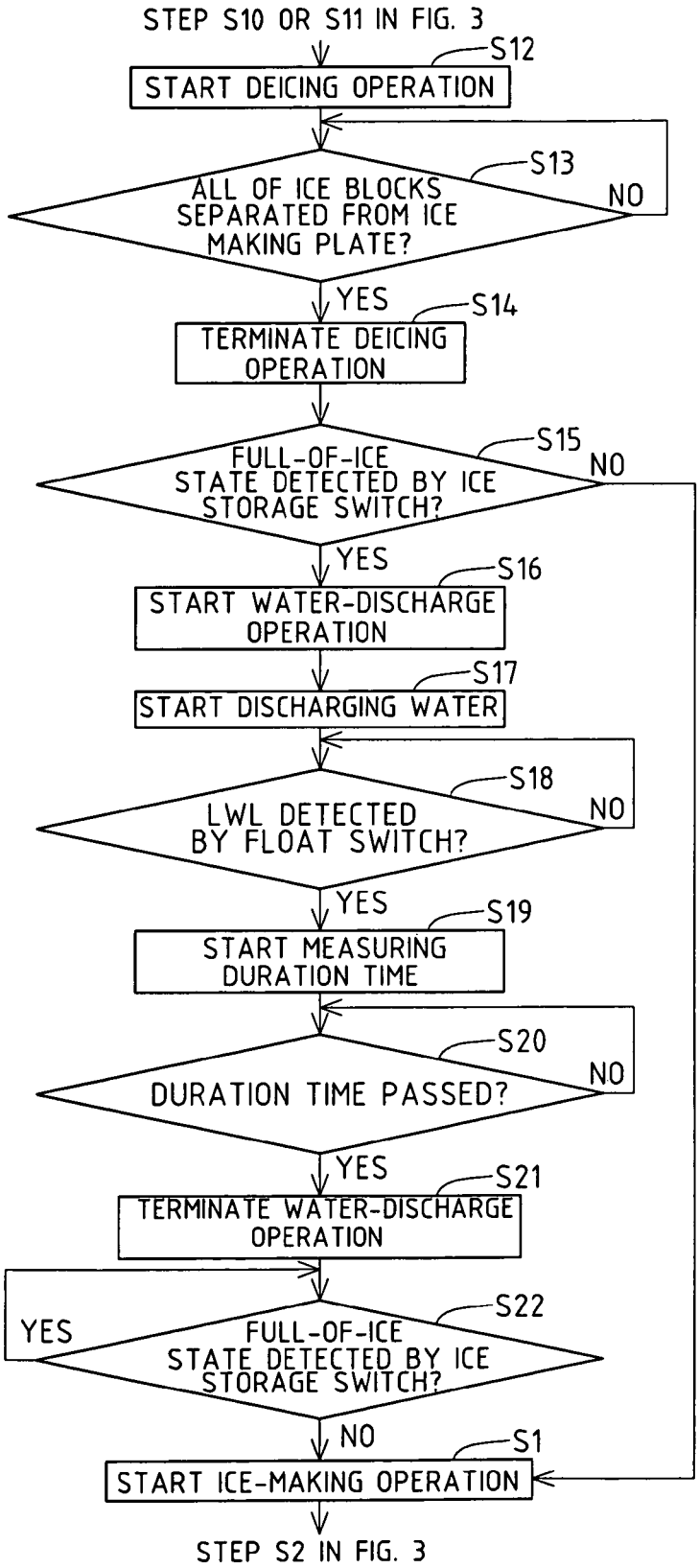
FIG. 4 is a flowchart illustrating a special water-discharge operation of the ice making machine according to the embodiment.
Figure 5:
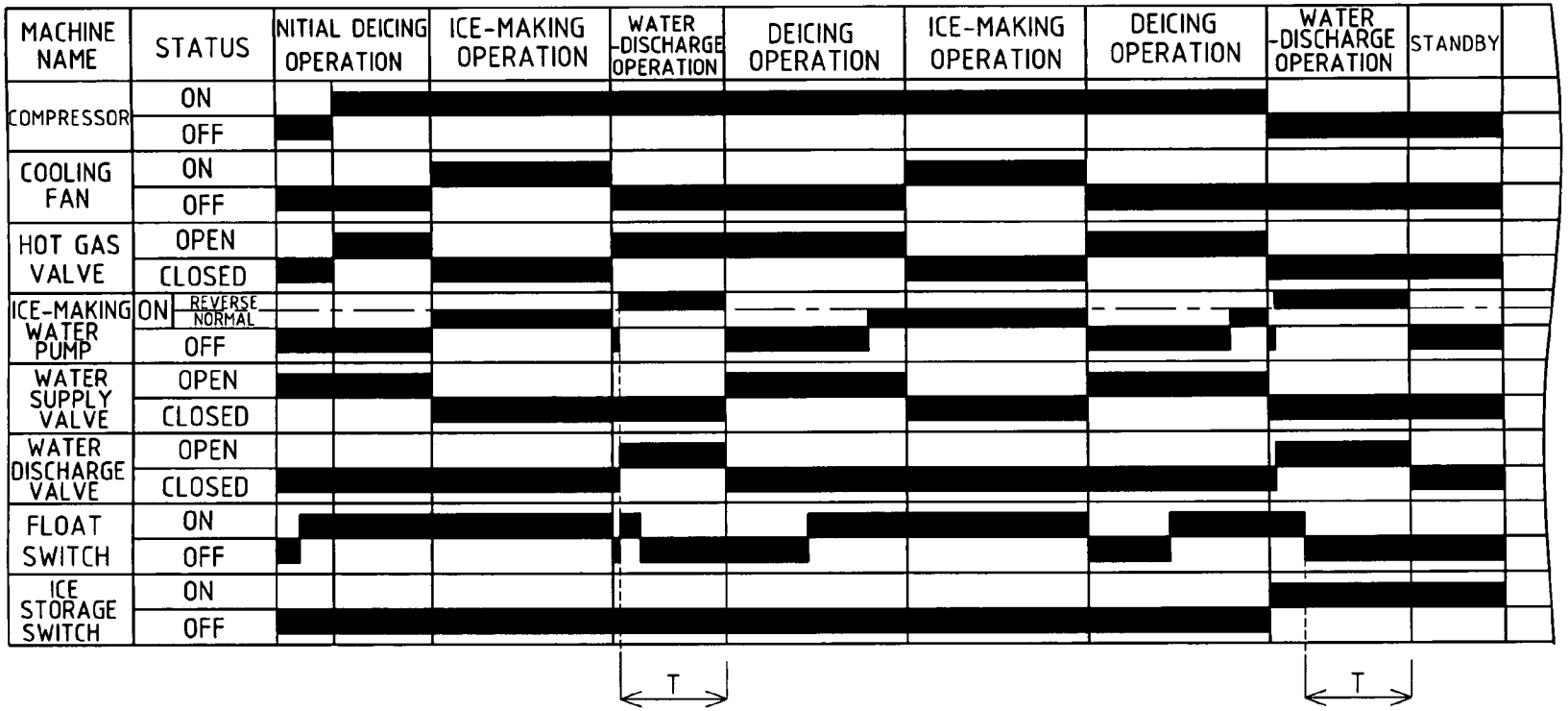
FIG. 5 is a timing chart illustrating the operations of individual components of the ice making machine according to the embodiment.

Next, the method of operating the ice making machine according to the embodiment will be described below referring to flowcharts in FIG. 3 and FIG. 4 or a timing chart shown in FIG. 5. As shown in FIG. 5, when the ice making machine is activated from the halt state, an initial deicing operation is started. In the initial deicing operation, the water supply valve WV is released to supply ice-making water to the ice-making water tank 20, after which the compressor CM is driven and the hot gas valve HV is released. Then, when completion of deicing is determined by deicing detection means (not shown), such as a temperature sensor and a timer, provided at the ice making plate 10, the water supply valve WV and the hot gas valve HV are closed to terminate the initial deicing operation and shift to the ice-making operation.

In the ice-making operation, the cooling fan FM is driven to forcibly cool the ice making plate 10 by the cooling action of the freezing apparatus 12, and the ice-making water pump PM is driven in the normal rotational direction, supplying ice-making water to the ice making plate 10 from the ice-making water tank 20 (step S1). Note that at the beginning of the ice-making operation, the ice-making water is stored in the ice-making water tank 20 up to the ice-making start water level HWL defined by the overflow pipe 30, so that the float switch FS is ON. The ice-making water starts being gradually iced on the ice-making surface of the ice making plate 10, and uniced water which flows down, uniced, on the ice making plate 10 is collected into the ice-making water tank 20 through the apertures of the guide plate 18 and is supplied to the ice making plate 10 again by the operation of the ice-making water pump PM. Ice blocks M are produced on the ice-making surface of the ice making plate 10, and when the float switch FS becomes OFF (step S2: YES) as a result of the ice-making water in the ice-making water tank 20 falling down to the ice-making completion water level LWL, the ice-making water is completed (step S3). In the ice making machine, the cooling fan FM is stopped to stop cooling the ice making plate 10, and the ice-making water pump PM is stopped to stop supplying the ice-making water to the ice making plate 10.

When the ice-making operation is completed, it is determined whether or not it is a cycle of performing the water-discharge operation before going to the deicing operation (step S4). That is, the ice making machine is configured in such a way that every time a set number preset in the counter 50 is reached, the normal water-discharge operation is performed before the deicing operation, and when the counter 50 reaches the set number (step S4: YES), the normal water-discharge operation is started (step S5) after resetting the counter 50. When the counter 50 has not reached the set number (step S4: NO), the deicing operation is started (step S12) after incrementing the count of the counter 50 (step S11). The set number of the counter 50 is adequately set between one to multiple times, and every time one ice-making operation is completed, the normal water-discharge operation is performed, or every time the ice-making operation is performed multiple times, the normal water-discharge operation is performed.

When the normal water-discharge operation is started (step S5), the ice-making water pump PM is stopped upon completion of the ice-making operation, and after standby for a delay time (step S6: YES), the ice-making water pump PM is driven in the reverse rotational direction and the water discharge valve DV is released. The delay time is provided because if water pressure is kept applied with the ice-making water pump PM driven, the water discharge valve DV may not be released. With the ice-making water pump PM driven in the reverse rotational direction and the water discharge valve DV released, the ice-making water remaining in the ice-making water tank 20 at the ice-making completion water level LWL upon completion of the ice-making operation is discharged outside via the water discharge pipe 46 and the overflow pipe 30 (step S7). The time measuring means 52 of the control means 32 starts measuring the time (step S8) at the same time as discharge of the ice-making water from the ice-making water tank 20 is started, and the ice-making water is discharged from the ice-making water tank 20 over the duration time T by the water discharge means 44. Further, the ice-making water is supplied to the sub tank 20*b* from the sub water discharge pipe 48 to clean the sub tank 20*b*. Because the ice-making water is pumped out by the ice-making water pump PM, the discharge operation of the water discharge means 44 can be shortened. When the duration time T passes after the water discharge means 44 has started discharging the ice-making water (step S9: YES), the ice-making water pump PM is stopped and the water discharge valve DV is closed, terminating the normal water-discharge operation (step S10). Note that the duration time T is set to the time that allows the water discharge means 44 to discharge the ice-making water at the ice-making completion water level LWL.

As the ice making machine performs the normal water-discharge operation after completion of the ice-making operation in the above manner, an impurity can be prevented from being condensed in the ice-making water in the ice-making water tank 20, making it difficult for the impurity to be deposited to the ice-making water tank 20 and the ice-making water supply system. In addition, because the impurity contained in the ice-making water to be supplied to the ice making plate 10 can be reduced, clean ice blocks M can be produced. Because the normal water-discharge operation merely discharges ice-making water which is consumed in producing ice blocks M to fall down to the ice-making completion water level LWL in the ice-making operation, the total amount of ice-making water to be discharged is small, and the discharge does not take much time. That is, it is possible to minimize reduction in the ice-making performance which may be caused by performing the normal water-discharge operation.

When the counter 50 has not reached the set number (step S4: NO) after the normal water-discharge operation is completed (step S10), or when the ice-making operation is completed, the deicing operation is started (step S12). With the operation of the compressor CM maintained, as the hot gas valve HV is kept released or the hot gas valve HV is released in the ice making machine, the ice making plate 10 is heated with the hot gas supplied to the evaporation pipe 14 via the hot gas pipe 42, so that melting of the icing surfaces of the ice blocks M with the ice making plate 10 starts. In the ice making machine, the water supply valve WV is released to start supplying the deicing water to the deicing water sprayer 28, so that the deicing water deicing water is sprayed onto the back of the ice making plate 10 through the spray holes, thereby increasing the temperature of the ice making plate 10 and accelerating melting of the icing surfaces of the ice blocks M with the ice making plate 10. In the later stage of the deicing operation, the ice-making water pump PM is driven in the reverse rotational direction to supply the ice-making water to the ice making plate 10. Then, when the deicing detection means detects separation of ice blocks M from the ice making plate 10 (step S13: YES), the hot gas valve HV and the water supply valve WV are closed, terminating the deicing operation (step S14).

When the deicing operation is completed, it is determined whether or not the ice storage chamber 16 is full of ice (step S15). When the ice storage switch TS detects ice blocks M (ON) (step S15: YES), the special water-discharge operation is started (step S16). When the ice storage switch TS does not detect ice blocks M (OFF) (step S15: NO), on the other hand, the ice-making operation is started without performing the special water-discharge operation (step S1).

When the special water-discharge operation is started, the compressor CM is stopped, the ice-making water pump PM is stopped upon completion of the deicing operation, and after standby for a delay time, the ice-making water pump PM is driven in the reverse rotational direction, and the water discharge valve DV is released at the same time. With the ice-making water pump PM driven in the reverse rotational direction and the water discharge valve DV released, the ice-making water remaining in the ice-making water tank 20 at the ice-making start water level HWL upon completion of the deicing operation is discharged outside via the water discharge pipe 46 and the overflow pipe 30 (step S17). When the float switch FS detects the ice-making completion water level LWL (step S18: YES), the time measuring means 52 of the control means 32 starts measuring the time (step S19), and the ice-making water is discharged from the ice-making water tank 20 over the duration time T by the water discharge means 44. When the duration time T passes after detection of the ice-making completion water level LWL by the float switch FS (step S20: YES), the ice-making water pump PM is stopped and the water discharge valve DV is closed, terminating the special water-discharge operation (step S21). When the ice storage chamber 16 is full of ice and the ice storage switch TS detects ice blocks M (ON) (step S22: YES), the ice making machine stands by without going to the ice-making operation. When the ice storage switch TS does not detect ice blocks M (OFF) (step S22: NO), on the other hand, the ice-making operation is started (step S1).

As apparent from the above, when the ice storage chamber 16 becomes full of ice, there is no standby with ice-making water remaining in the ice-making water tank 20, and the special water-discharge operation is performed immediately after completion of the deicing operation to avoid the problem of breeding of bacteria in the ice-making water tank 20, deposition of an impurity therein, or the like. In addition, the ice making machine need not perform the water-discharge operation before starting the ice-making operation as a result of consumption of ice blocks M in the ice storage chamber 16, and can immediately start the ice-making operation when the ice storage switch TS does not detect ice blocks M (OFF). Although a large amount of ice-making water at the ice-making start water level HWL is stored in the ice-making water tank 20 upon completion of the deicing operation, measuring the duration time T is started when the float switch FL detects the ice-making completion water level LWL or the amount of the ice-making water becomes small, so that the predictability of the time needed to discharge the remaining ice-making water is high. Even when the discharge amount per unit time is changed due to deposition of an impurity to the water discharge means 44 or the like, a small amount of ice-making water at or below the ice-making completion water level LWL is discharged in the duration time T, so that the influence of the change is not significant. That is, the extra time which is considered as the duration time T can be shortened, or the extra time is unnecessary, it is possible to minimize the time needed for the special water-discharge operation. When the ice storage switch TS does not detect ice blocks M (OFF), therefore, the ice-making operation can be started immediately, so that the ice-making performance is not degraded.

Because the float switch FS or means to detect completion of ice-making in the ice-making operation is used in the special water-discharge operation, and the duration time T in the special water-discharge operation is the same as that in the normal water-discharge operation, the special water-discharge operation can be performed without increasing the components or the setting.

Modifications

The invention is not limited to the configuration of the embodiment, and can be modified as follows.

Figure 6:
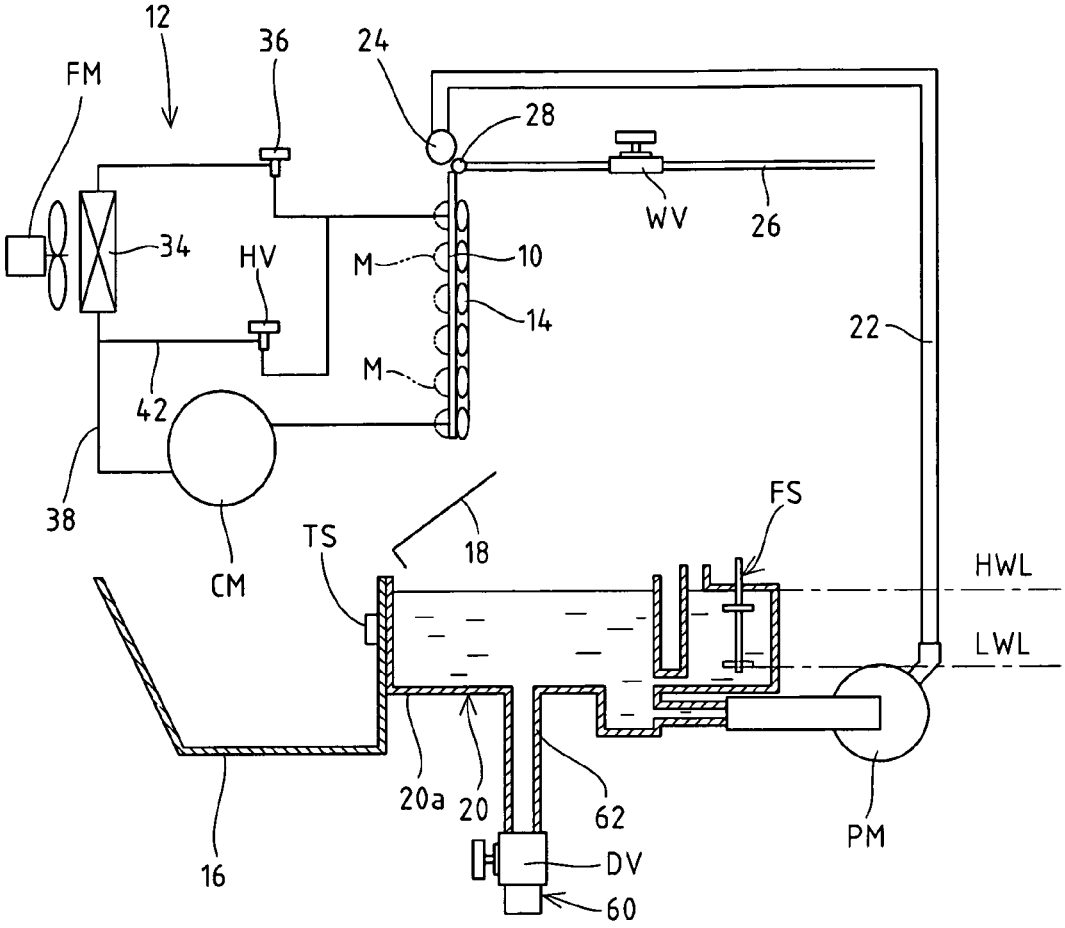
FIG. 6 is a schematic diagram showing an ice making machine according to a modification.

(1) As shown in FIG. 6, water discharge means 60 which has a discharge pipe 62 connected to the bottom of the ice-making water tank 20, and a water discharge valve DV intervened in the discharge pipe 62 to open or close the discharge pipe 62 under the control of the control means 32 may be employed. The water discharge means 60 according to the modification eliminates the need for a delay time provided in the embodiment, and releases the water discharge valve DV at the same time as the water-discharge operation is started. Same reference numerals are given to those components of the modification which are the same as the corresponding components of the embodiment to omit their description. According to the modification, control on the normal/reverse rotation of the ice-making water pump PM can be omitted.

(2) Although the description of the embodiment has been given of a down flow type ice making machine by way of example, the invention can be adapted to an open cell or closed cell type spray ice making machine.

(3) Although a delay time is provided in the embodiment, it is not essential.

The invention claimed is:

1. A method of operating an ice making machine which performs an ice-making operation by ordered steps comprising supplying ice-making water from an ice-making water tank to a cooled ice making part to produce ice blocks in the ice making part, collecting uniced water flowing down from the ice making part into the ice-making water tank to be circulated as ice-making water, performing a deicing operation by heating the ice making part to separate the ice blocks from the ice making part, and performing a water-discharge operation by discharging the ice-making water from the ice-making water tank via water discharge means communicating with outside, wherein:

the water discharge means comprises an ice-making water pump that also serves as a pump in an ice-making water supply system, an overflow pipe provided in the ice-making water tank, a water discharge pipe that has one end connected to the ice-making water pump and a discharge end positioned above the overflow pipe, and a water discharge valve intervened in the water discharge pipe to open or close a passage of the water discharge pipe, and the water-discharge operation comprises a normal water-discharge operation that is performed for each preset cycle after completion of ice-making operation and a special water-discharge operation that is performed when an ice storage detection means provided at an ice storage chamber storing the ice blocks separated in the deicing operation detects that the ice storage chamber is full of ice, the method terminating the normal water-discharge operation by closing the water discharge valve when a preset duration time has passed after the water discharge valve provided at the water discharge pipe of the water discharge means is released, and terminating the special water-discharge operation by closing the water discharge valve when a preset duration time passes after water level detection means provided at the ice-making water tank detects a prescribed water level of the ice-making water in the ice-making water tank after discharge of the ice-making water to outside is started.

* * * * *